US011052679B2

(12) United States Patent
Ogawa

(10) Patent No.: US 11,052,679 B2
(45) Date of Patent: Jul. 6, 2021

(54) APPARATUS FOR DISCHARGING LIQUID

(71) Applicant: Masato Ogawa, Kanagawa (JP)

(72) Inventor: Masato Ogawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/815,000

(22) Filed: Mar. 11, 2020

(65) Prior Publication Data

US 2020/0290371 A1 Sep. 17, 2020

(30) Foreign Application Priority Data

Mar. 14, 2019 (JP) ..... JP2019-047700
Aug. 2, 2019 (JP) ..... JP2019-142664

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 11/00216; B41J 11/00214; B41J 11/0022; B41J 11/007
See application file for complete search history.

(56) References Cited

U.S. PATENT DOCUMENTS

| | | | | |
|---|---|---|---|---|
| 2017/0266987 | A1 | 9/2017 | Asada et al. | |
| 2017/0266988 | A1 | 9/2017 | Asada et al. | |
| 2017/0266989 | A1 | 9/2017 | Ogawa et al. | |
| 2017/0334218 | A1 | 11/2017 | Ogawa et al. | |
| 2018/0016106 | A1* | 1/2018 | Asada | B65H 29/245 |
| 2018/0147878 | A1 | 5/2018 | Asada et al. | |
| 2018/0264852 | A1 | 9/2018 | Ohtake et al. | |

FOREIGN PATENT DOCUMENTS

| | | |
|---|---|---|
| JP | 2004-142140 | 5/2004 |
| JP | 2012-131065 | 7/2012 |
| JP | 2013-047136 | 3/2013 |
| WO | WO2016/190335 A1 | 12/2016 |

* cited by examiner

*Primary Examiner* — Bradley W Thies
(74) *Attorney, Agent, or Firm* — Xsensus LLP

(57) ABSTRACT

An apparatus for discharging liquid includes a rotary member, a liquid applier, a conveyance belt, a first heater, and a second heater. The rotary member is configured to convey a sheet material. The liquid applier is configured to apply liquid to the sheet material conveyed by the rotary member. The conveyance belt is configured to convey the sheet material fed from the rotary member. The first heater is configured to heat the sheet material between the rotary member and the conveyance belt. The second heater is configured to heat the sheet material conveyed by the conveyance belt.

12 Claims, 9 Drawing Sheets

APPARATUS FOR DISCHARGING LIQUID

CROSS-REFERENCE TO RELATED APPLICATIONS

This patent application is based on and claims priority pursuant to 35 U.S.C. § 119(a) to Japanese Patent Application Nos. 2019-047700, filed on Mar. 14, 2019, and 2019-142664, filed on Aug. 2, 2019, in the Japan Patent Office, the entire disclosure of each of which is incorporated by reference herein.

BACKGROUND

Technical Field

Aspects of the present disclosure relates to an apparatus for discharging liquid.

Related Art

As an apparatus including a head which discharges liquid, there is an apparatus including a dryer which dries a sheet material (applying member) to which the liquid is applied.

For example, there is known an apparatus which applies liquid from a head while holding paper by a cylindrical drum to convey, and dries the paper to which the liquid is applied transferred from the drum while conveying the same by a chain gripper.

SUMMARY

In an aspect of the present disclosure, there is provided an apparatus for discharging liquid includes a rotary member, a liquid applier, a conveyance belt, a first heater, and a second heater. The rotary member is configured to convey a sheet material. The liquid applier is configured to apply liquid to the sheet material conveyed by the rotary member. The conveyance belt is configured to convey the sheet material fed from the rotary member. The first heater is configured to heat the sheet material between the rotary member and the conveyance belt. The second heater is configured to heat the sheet material conveyed by the conveyance belt.

In another aspect of the present disclosure, there is provided an apparatus for discharging liquid. The apparatus includes a rotary member, a liquid applier, a conveyance belt, a first drier, and a second drier. The rotary member is configured to convey a sheet material. The liquid applier is configured to apply liquid to the sheet material conveyed by the rotary member. The conveyance belt is configured to convey the sheet material fed from the rotary member. The first drier is configured to dry the sheet material between the rotary member and the conveyance belt. The second drier is configured to dry the sheet material conveyed by the conveyance belt.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
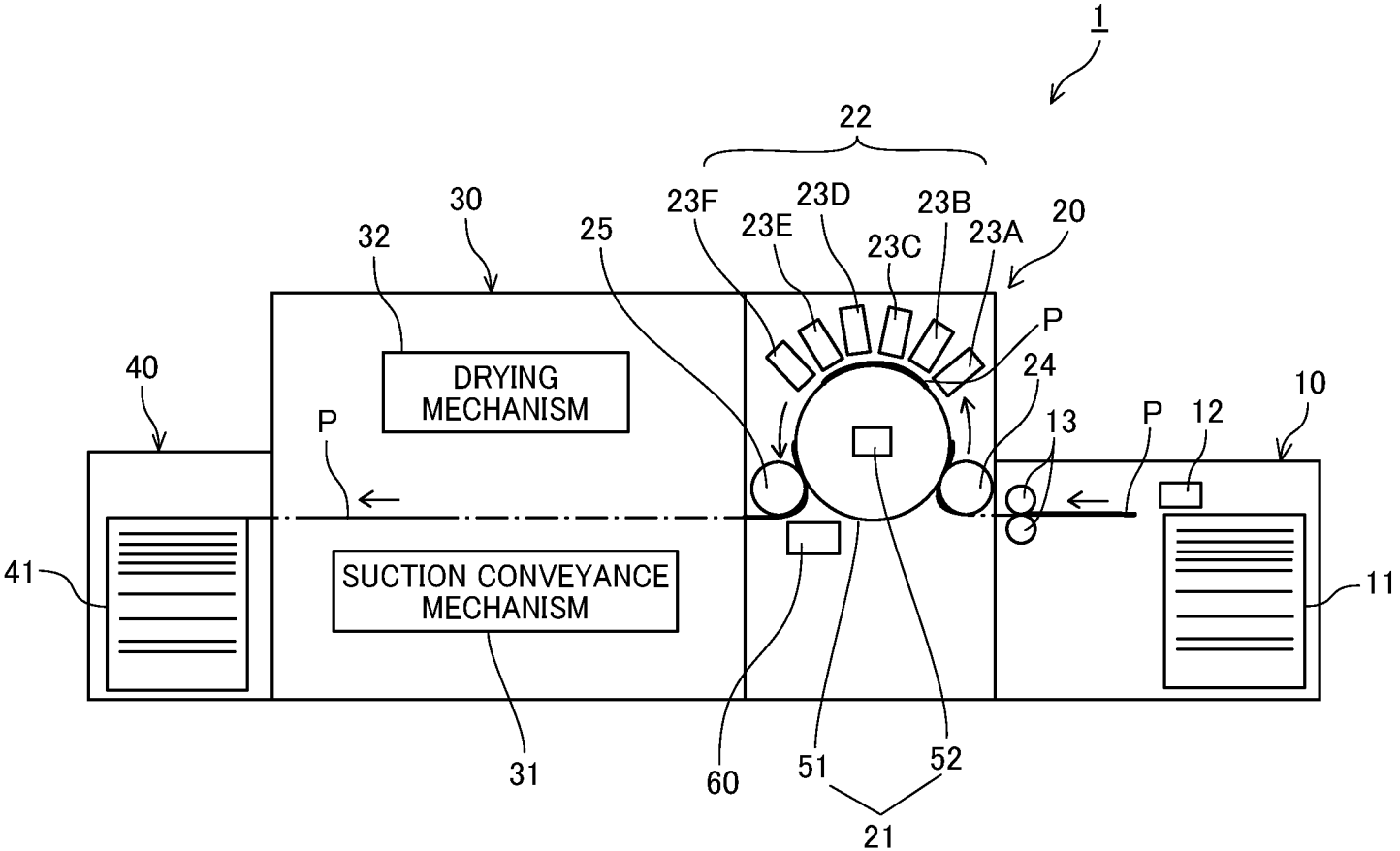
FIG. 1 is a schematic view of a printing apparatus that is an apparatus for discharging liquid according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Figure 2:
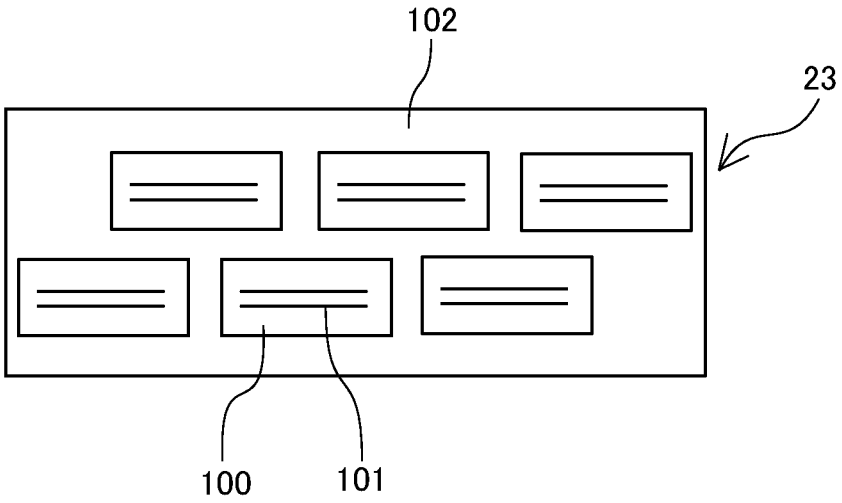
FIG. 2 is a planar view of an example of a discharge unit of the printing apparatus.

Referring now to the drawings, embodiments of the present disclosure are described below. In the drawings for explaining the following embodiments, the same reference codes are allocated to elements (members or components) having the same function or shape and redundant descriptions thereof are omitted below. First, a first embodiment of the present disclosure is described referring to FIGS. 1 and 2. FIG. 1 is a schematic illustrative view of a printing apparatus being an apparatus which discharges liquid according to the embodiment, and FIG. 2 is a planar illustrative view of an example of a discharge unit of the printing apparatus.

A printing apparatus 1 includes with a loader 10, a printer 20, a dryer 30, and an unloader 40. The printing apparatus 1 applies liquid to a sheet material P loaded from the loader 10 and performs required printing thereon by the printer 20, dries the liquid adhering to the sheet material P by the dryer 30, and thereafter discharges the sheet material P to the unloader 40.

The loader 10 includes a load tray 11 on which a plurality of sheet materials P is stacked, a feeding device 12 which separates the sheet materials P one by one to send from the load tray 11, and a registration roller pair 13 which feeds the sheet material P to the printer 20.

As the feeding device 12, any feeding device such as a device using a roller or a device using air suction may be used. After a leading end of the sheet material P sent from the load tray 11 by the feeding device 12 reaches the registration roller pair 13, the registration roller pair 13 is driven at a predetermined timing to send the sheet material P to the printer 20.

The printer 20 includes a sheet conveying device 21 which conveys the sheet material P. The sheet conveying device 21 includes a drum 51 which is a supporting member (rotary member) which rotates while supporting the sheet material P on a peripheral surface thereof, and a suction device 52 which is a suction device which generates a suction force on the peripheral surface of the drum 51.

The printer 20 also includes a liquid discharger 22 which discharges to apply the liquid to the sheet material P which is carried by the drum 51 of the sheet conveying device 21 to be conveyed.

The printer 20 also includes a transfer cylinder 24 which receives the fed sheet material P and passes the sheet material P to the drum 51, and a transfer cylinder 25 which transfers the sheet material P conveyed by the drum 51 to the dryer 30.

The sheet material P conveyed from the loader 10 to the printer 20 is gripped at the leading end by a gripper provided on the transfer cylinder 24 and conveyed as the transfer cylinder 24 rotates. The sheet material P conveyed by the transfer cylinder 24 is transferred to the drum 51 at a position facing the drum 51.

As is to be described later referring to FIG. 9, a gripper 81 is provided on a surface of the drum 51, and the leading end of the sheet material P is gripped by the gripper 81. A plurality of suction holes is dispersedly formed on the surface of the drum 51. The suction device 52 which is the suction device generates a suction airflow inward from a required suction hole of the drum 51.

The sheet material P transferred from the transfer cylinder 24 to the drum 51 is gripped at the leading end by the gripper 81, attracted to be supported on the drum 51 by the suction airflow by the suction device 52, and conveyed as the drum 51 rotates.

The liquid discharger 22 includes discharge units 23 (23A to 23F) being liquid appliers. For example, the discharge unit 23A discharge a cyan (C) liquid, the discharge unit 23B discharges a magenta (M) liquid, the discharge unit 23C discharges a yellow (Y) liquid, and the discharge unit 23D discharges a black (K) liquid, respectively. The discharge units 23E and 23F are used for discharging any one of YMCK liquids or special liquids such as white and gold (silver). A discharge unit which discharges a processing liquid such as a surface coating liquid may also be provided.

For example, as illustrated in FIG. 2, the discharge unit 23 is a full line head in which a plurality of liquid discharge heads (hereinafter simply referred to as "heads") 100 including a nozzle row 101 in which a plurality of nozzles is arranged is arranged on a base member 102.

Discharge operation of each discharge unit 23 of the liquid discharger 22 is controlled by a drive signal corresponding to print information. When the sheet material P supplied on the drum passes through a region facing the liquid discharger 22, the liquid of each color is discharged from the discharge unit 23, and an image corresponding to the print information is printed.

The sheet material P to which the liquid is applied by the liquid discharger 22 is sent from the surface of the drum 51 to the transfer cylinder 25 which is a rotary transfer body. On a surface of the transfer cylinder 25 also, as is to be described later referring to FIG. 9, a gripper 82 which grips the leading end of the sheet material P is provided, and as the gripper 82 of the transfer cylinder 25 grips the leading end of the sheet material P which has been gripped by the gripper 81 of the drum 51, the sheet material P is transferred from the surface of the drum 51 to the transfer cylinder 25.

Then, the sheet material P is passed to a suction conveyance mechanism 31 of the dryer 30 through a peripheral surface (transfer path) of the transfer cylinder 25 by the rotation of the transfer cylinder 25.

Herein, between the printer 20 and the dryer 30, a first dryer 60 as a first heater which dries the sheet material P on the transfer path by the transfer cylinder 25 is arranged, and this heats the liquid adhered to the sheet material P in the printer 20 by the first dryer 60 to dry.

The dryer 30 includes the suction conveyance mechanism 31 which is a conveyor which conveys (sucks to convey) the sheet material P passed from the transfer cylinder 25 of the printer 20 in a sucked state and a drying mechanism 32 which dries the liquid on the sheet material P conveyed by the suction conveyance mechanism 31.

The sheet material P to which the liquid is applied by the printer 20 is dried by the first dryer 60 when this is passed to the suction conveyance mechanism 31 by the transfer cylinder 25, and is further heated to be dried by the drying mechanism 32 which is a second dryer as a second heater while being conveyed by the suction conveyance mechanism 31 and is transferred to the unloader 40.

When passing through the drying mechanism 32, the liquid on the sheet material P which is dried (pre-dried) by the first dryer 60 is further subjected to a drying process.

As a result, a liquid component such as moisture in the liquid evaporates, a colorant contained in the liquid is surely fixed on the sheet material P, and curl of the sheet material P is suppressed.

The unloader 40 includes an unload tray 41 on which a plurality of sheet materials P is stacked. The sheet material P conveyed from the dryer 30 is sequentially stacked on the unload tray 41 to be held.

In the printing apparatus 1, for example, a pre-processor which performs a pre-process on the sheet material P may be arranged on an upstream side of the printer 20, or a post-processor which performs a post-process on the sheet material P to which the liquid adheres may be arranged between the dryer 30 and the unloader 40.

Examples of the pre-processor include, for example, that which performs a pre-coating process in which a treatment liquid which reacts with the liquid to suppress bleeding is applied to the sheet material P. Examples of the post-processor include, for example, that which performs a sheet reversing/conveying process for reversing the sheet printed by the printer 20 and sending the same again to the printer 20 to print on both sides of the sheet material P, and that which performs a process of binding a plurality of sheets.

Although the printing apparatus that prints on the sheet material P which is cut is described as the apparatus for discharging liquid, in some embodiment, the apparatus for discharging liquid may be a printing apparatus that prints on a continuous material such as continuous paper.

Herein, ink as the liquid used in the printing apparatus 1 is described.

The ink of this embodiment is water-based ink and includes an organic solvent, water, a color material, resin, and an additive.

Ink

The organic solvent, water, color material, resin, additive, and the like used in the ink are described below.

Organic Solvent

The organic solvent used in embodiments of the present disclosure is not limited in particular, and a water-soluble organic solvent may be used. Examples thereof include, for example, polyvalent alcohols, ethers such as polyvalent alcohol alkyl ethers and polyvalent alcohol aryl ethers, nitrogen-containing heterocyclic compounds, amides, amines, and sulfur-containing compounds.

It is preferable to use an organic solvent having a boiling point of 250° C. or lower because this not only serves as a wetting agent but also provides excellent drying properties.

A content of the organic solvent in the ink is not limited in particular and may be appropriately selected according to the purpose; but is preferably 10% by mass or more and 60% by mass or less and is more preferably 20% by mass or more and 60% by mass or less from the viewpoint of drying property and ejection reliability of the ink.

Water

A water content in the ink is not limited in particular and may be appropriately selected according to the purpose; but is preferably 10% by mass or more and 90% by mass or less and is more preferably 20% by mass or more and 60% by mass or less from the viewpoint of drying property and ejection reliability of the ink.

Color Material

The color material is not limited in particular, and pigments and dyes may be used.

An inorganic pigment or an organic pigment may be used as the pigments. One single type or combination of two or more types may be used. A mixed crystal may be used as the pigment.

A content of the color material in the ink is preferably 0.1% by mass or more and 15% by mass or less and is more preferably 1% by mass or more and 10% by mass or less from the viewpoint of improvement in image density, an excellent fixing property, and ejection stability.

As the pigment, for example, a black pigment, a yellow pigment, a magenta pigment, a cyan pigment, a white pigment, a green pigment, an orange pigment, a glossy pigment such as gold or silver, a metallic pigment and the like may be used.

Resin

A type of resin contained in the ink is not limited in particular and may be appropriately selected according to the purpose; for example, urethane resin, polyester resin, acrylic resin, vinyl acetate resin, styrene resin, butadiene resin, styrene-butadiene resin, vinyl chloride resin, acrylic styrene resin, acrylic silicone resin and the like are included.

A content of resin is not limited in particular and may be appropriately selected according to the purpose; but is preferably 1% by mass or more and 30% by mass or less and is more preferably 5% by mass or more and 20% by mass or less with respect to an entire ink amount from the viewpoint of fixing property and keeping stability of the ink.

Additive

A surfactant, an antifoaming agent, an antiseptic/antifungal agent, a rust inhibitor, a pH adjuster and the like may also be added to the ink as required.

Figure 3:
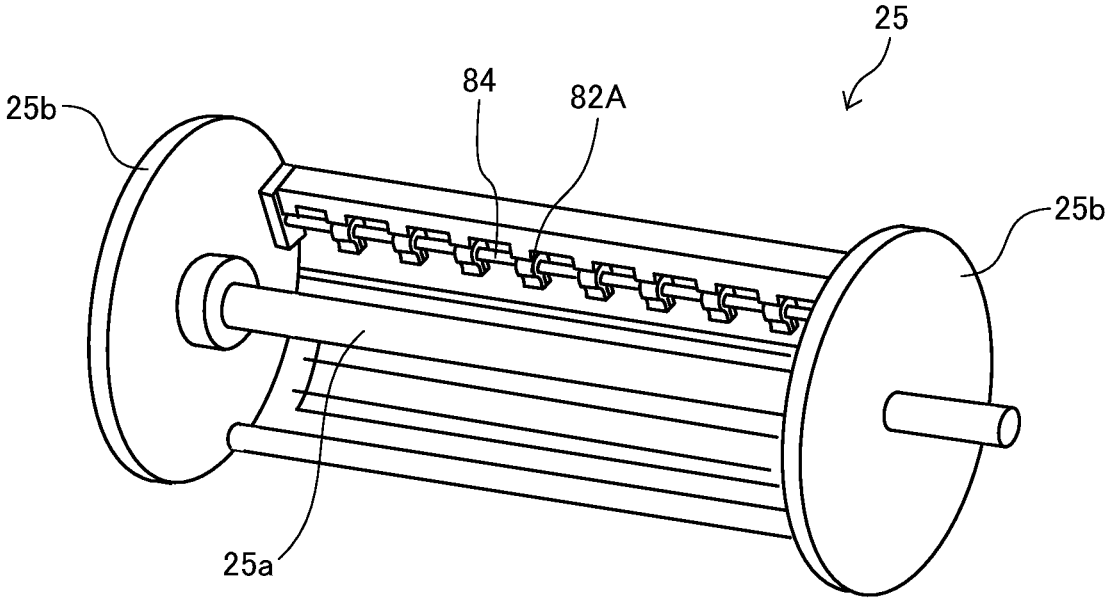
FIG. 3 is a perspective view of an example of a transfer cylinder of the printing apparatus.

Next, an example of the transfer cylinder which is the rotary transfer body is described referring to FIG. 3. FIG. 3 is a perspective illustrative view of the transfer cylinder.

The transfer cylinder 25 includes a rotating shaft 25*a*, flanges 25*b* and 25*b* attached to both ends of the rotating shaft 25*a*, a holding member 84 stretched between the flanges 25*b* and 25*b*, and a gripper 82A including a plurality of grippers 82 (refer to FIG. 8) held by the holding member 84 and the like.

In this manner, in a width direction of the sheet material P, the transfer cylinder 25 is generally hollow except for the rotating shaft 25*a*, the gripper 82*a*, and the holding member 84, so that hot air and radiant heat may pass through the transfer cylinder 25 in a direction orthogonal to an axial direction.

Figure 4:
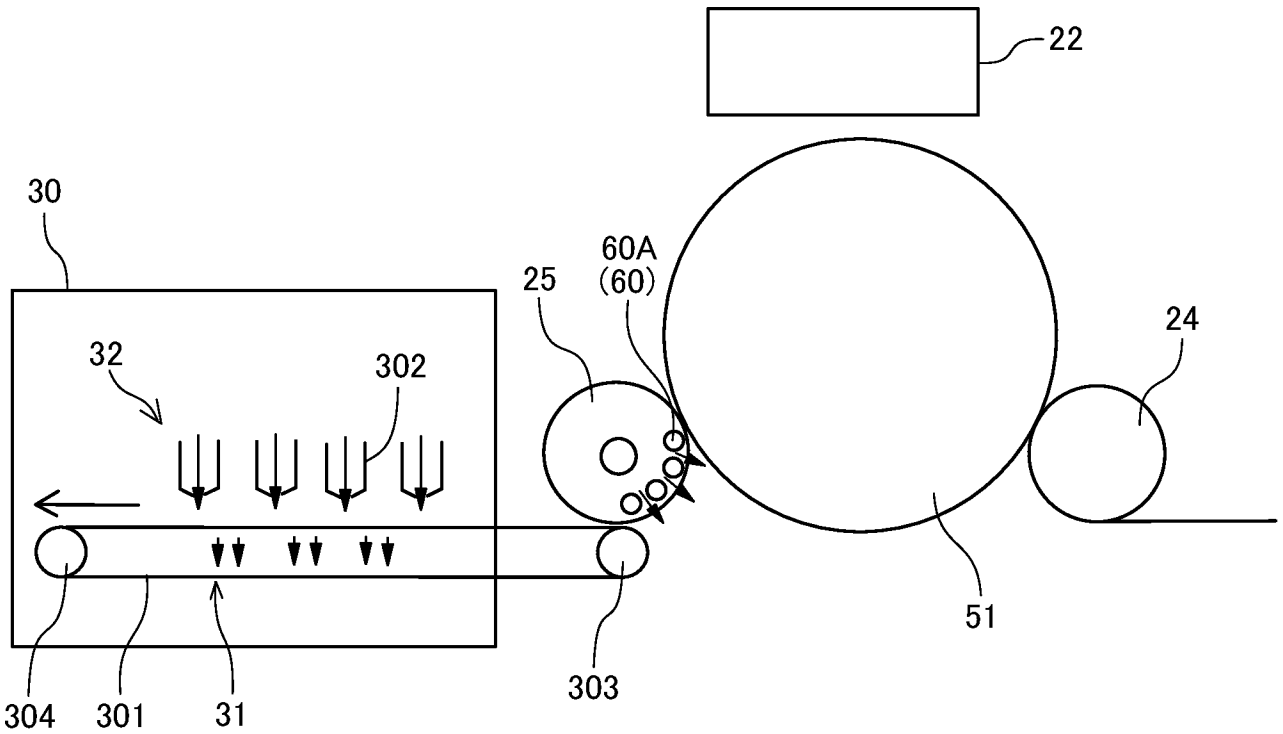
FIG. 4 is a schematic view a first dryer and a second dryer in the first embodiment.

Next, the first dryer (first heater) and the second dryer (second heater) in the first embodiment of the present disclosure are described referring to FIG. 4. FIG. 4 is an illustrative view of a substantial part for illustrating the first dryer and the second dryers.

In this embodiment, an infrared heater (IR heater) 60A which is a radiant heater is arranged as the first dryer 60 inside the transfer cylinder 25.

The suction conveyance mechanism 31 of the dryer 30 includes a suction conveyance belt 301 as a conveyance belt which attracts to convey the sheet material P sent from the drum 51 to be passed from the transfer cylinder 25, and the suction conveyance belt 301 is stretched between a driving roller 303 and a driven roller 304, and moves to rotate by drive of the driving roller 303.

The drying mechanism 32 of the dryer 30 includes a hot air blower 302 that blows hot air for drying the liquid to the sheet material P conveyed by the suction conveyance belt 301. The second dryer is not limited to the hot air blower 302, and a radiant heater, for example, an IR heater may also be used.

Herein, for example, a glass fiber mesh belt may be used as the suction conveyance belt 301. By using the mesh belt, it is possible to reduce flapping of the sheet material P due to rebound of the hot air blown from the hot air blower 302.

An amount of heat given to the sheet material P by the hot air blower 302 as the second dryer is made larger than the amount of heat applied to the sheet material P by the IR heater 60A as the first dryer.

As described above, the sheet material P is dried by the IR heater 60A as the first dryer 60 on the transfer path by the transfer cylinder 25 which transfers the sheet material P from the drum 51 to the suction conveyance belt 301 of the suction conveyance mechanism 31 that is the conveyor.

The hot air blower 302 of the drying mechanism 32 as the second dryer blows the hot air to the sheet material P dried by the IR heater 60A to further dry the same.

As a result, the liquid applied to the sheet material P may be surely dried, and a drying property is improved.

In other words, before the second dryer (drying mechanism 32) dries, the first dryer 60 dries at an early stage, so that drying unevenness, gloss unevenness, and image unevenness due to movement of the pigments on a printing surface (surface to which the liquid is applied) may be suppressed. In this state, the second dryer (drying mechanism 32) dries, so that reliable fixing may be performed and peeling off from the printing surface may be prevented.

As described above, a problem is confirmed that, in a case where the mesh belt is used as the suction conveyance belt 301, when the sheet material P is placed on the mesh belt having a mesh shape on a surface thereof in a state in which a water-based liquid (ink) is not dried well, a pattern corresponding to the shape of the mesh of the mesh belt appears on the image due to an uneven contact state between the belt 301 and the sheet material P.

Therefore, as in this embodiment, by drying (pre-drying) by the first heater before drying by the second heater (main-drying) on the suction conveyance belt 301, it is possible to prevent an abnormal image in which a mesh pattern of the mesh belt appears in the image. In other words, in a configuration in which the water-based liquid (ink) is applied to the sheet material and the sheet material is dried while being conveyed by the mesh belt, it is possible to prevent occurrence of the abnormal image by pre-drying before putting the sheet material on the mesh belt.

By using the ink including at least water as the liquid as in this embodiment, heat drying by the first dryer 60 and heat drying by the second dryer (drying mechanism 32) may be performed.

On the other hand, for example, in a case of using ultraviolet curable ink, if the ink is cured by ultraviolet (UV) irradiation in a position corresponding to the first dryer 60 (the transfer path by the transfer cylinder 25), it becomes not necessary to dry in a position of the second dryer.

Figure 5:
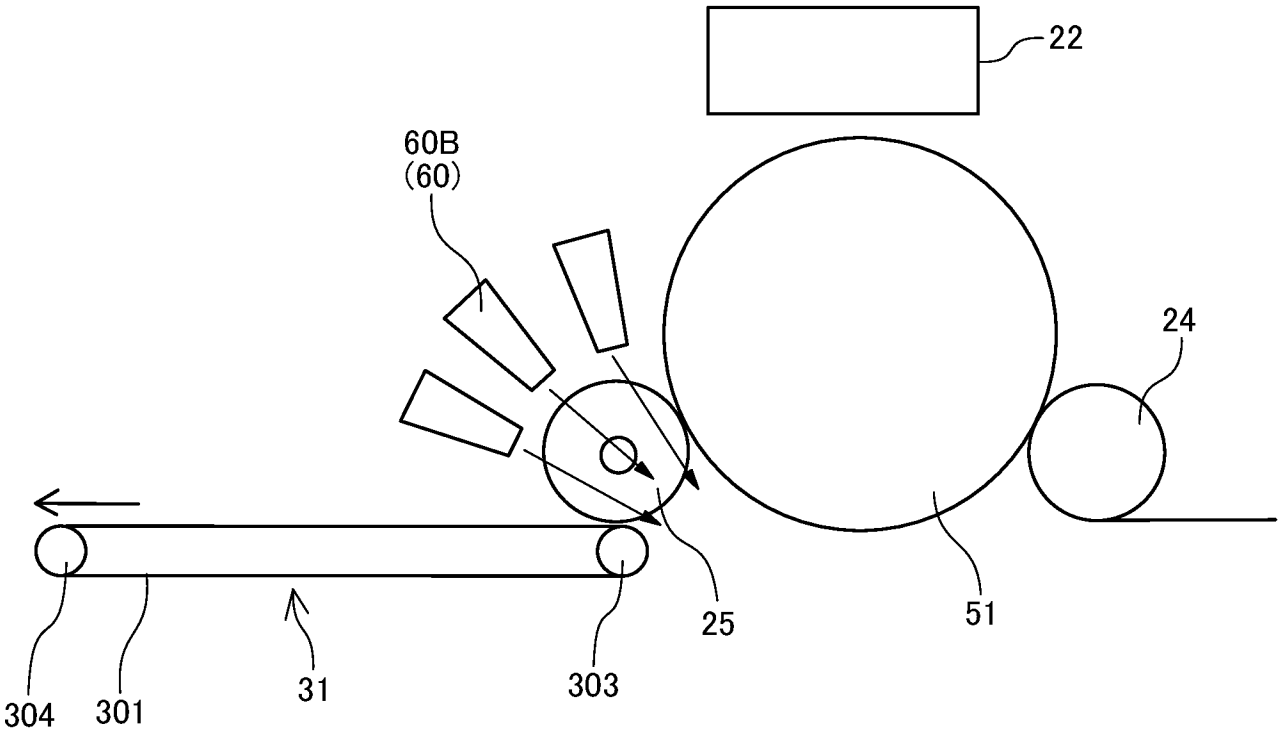
FIG. 5 is a schematic view of a first dryer in a second embodiment of the present disclosure.

Next, a first dryer in a second embodiment of the present disclosure is described referring to FIG. 5. FIG. 5 is an illustrative view of a substantial part for illustrating the first dryer.

In this embodiment, as a first dryer 60, a hot air blower 60B which blows hot air to a surface on which liquid is applied of a sheet material P from a back surface side of a transfer cylinder 25 is arranged for a transfer path by the transfer cylinder 25.

Even with such a configuration, an effect similar to that of the first embodiment may be obtained.

Figure 6:
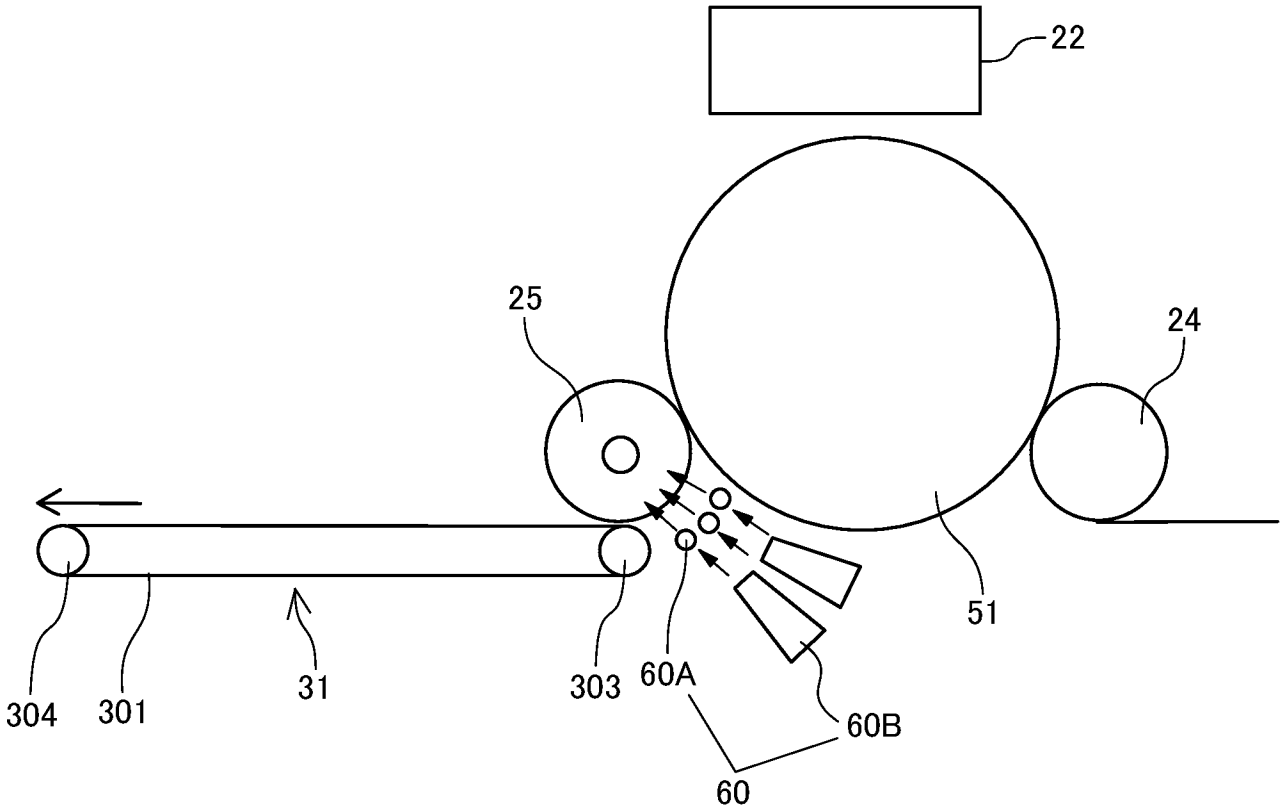
FIG. 6 is a schematic view of a first dryer in a third embodiment of the present disclosure.

Next, a first dryer in a third embodiment of the present disclosure is described referring to FIG. 6. FIG. 6 is an illustrative view of a substantial part for illustrating the first dryer.

In this embodiment, as a first dryer 60, an IR heater 60A which heats from a side opposite to a surface on which liquid is applied of a sheet material P and a hot air blower 60B which blows hot air are arranged for a transfer path by a transfer cylinder 25.

With such a configuration, an amount of heat applied to the sheet material P may be increased from that in the first and second embodiments.

Figure 7:
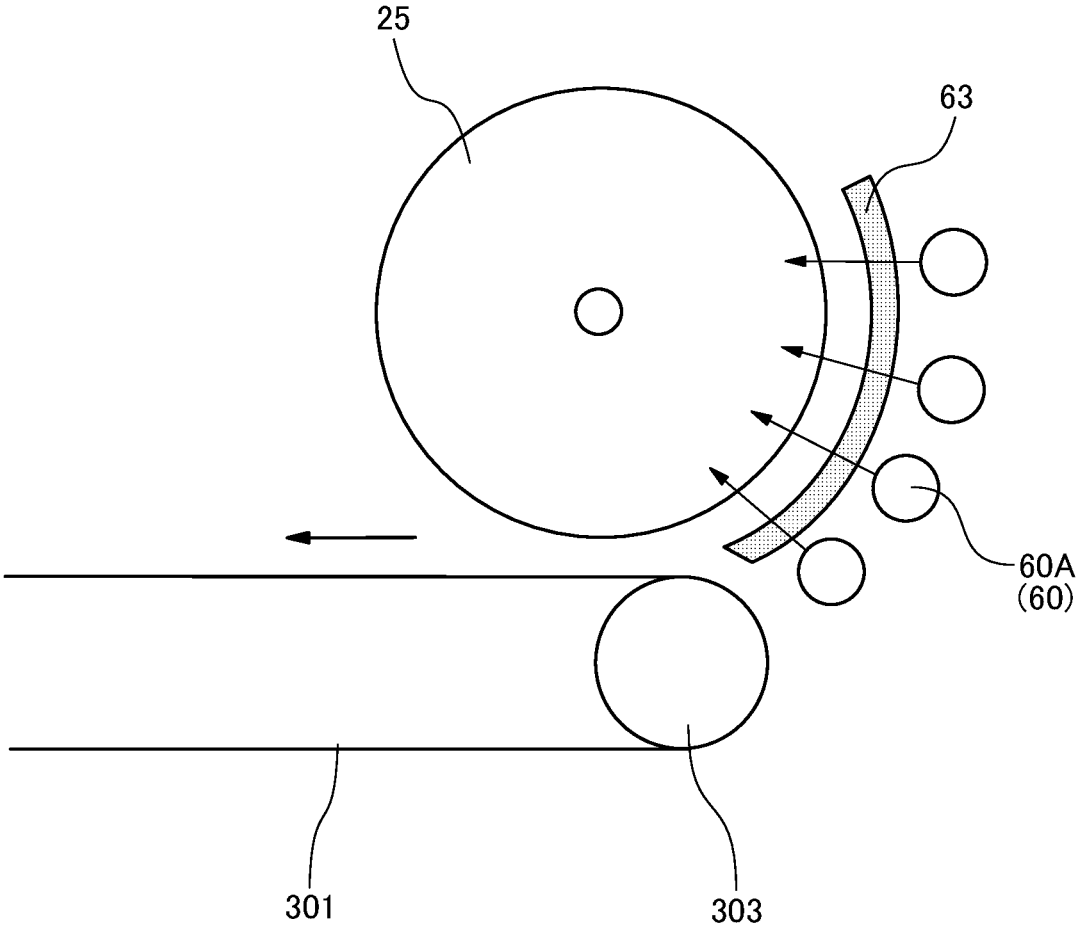
FIG. 7 is a schematic view of a first dryer in a fourth embodiment of the present disclosure.

Next, a first dryer in a fourth embodiment of the present disclosure is described referring to FIG. 7. FIG. 7 is an illustrative view of a substantial part for illustrating the first dryer.

In this embodiment, as a first dryer 60, an IR heater 60A which heats from a side opposite to a surface on which liquid is applied of a sheet material P is provided for a transfer path by a transfer cylinder 25, and a guide plate 63 being a guide member is arranged between the transfer cylinder 25 and the IR heater 60A.

In this manner, when a paper jam and the like occurs in the sheet material P, it is possible to prevent the sheet material P from coming into contact with the IR heater 60A.

Figure 8:
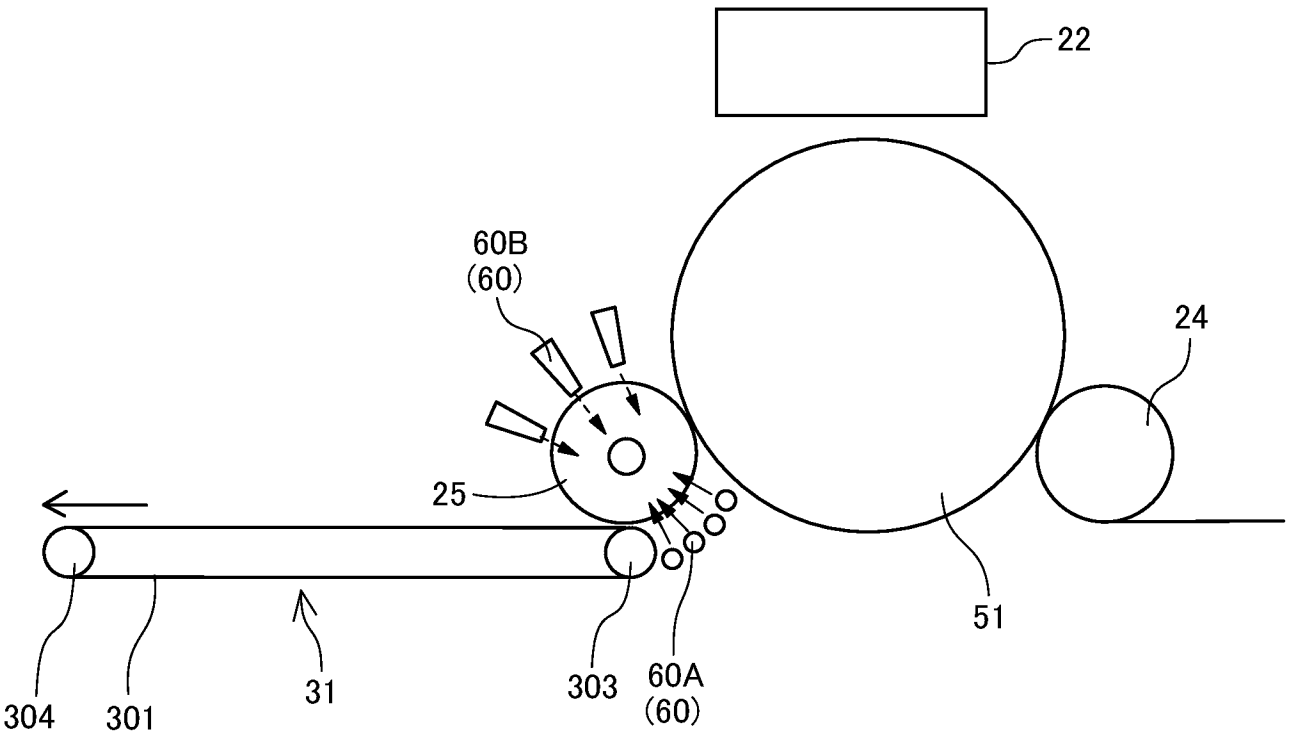
FIG. 8 is a schematic view of a first dryer in a fifth embodiment of the present disclosure.

Next, a first dryer in a fifth embodiment of the present disclosure is described referring to FIG. 8. FIG. 8 is an illustrative view of a substantial part for illustrating the first dryer.

In this embodiment, a transfer cylinder 25 has a smaller diameter (about ⅓ in this embodiment) than a diameter of a drum 51, and as described above referring to FIG. 3, in a region in a width direction to hold a sheet material P, a portion other than a gripper 82, a holding member 84, and a rotating shaft 25*a* is generally hollow.

The diameter of the transfer cylinder 25 is made a diameter in a circular rotation trajectory of the gripper 82 which holds the sheet material P, or a diameter of the flanges 25*b* which support the holding member 84 attached to both ends of the rotating shaft 25*a*.

As in the above-described fourth embodiment, as a first dryer 60, a hot air blower 60B which blows hot air to a surface (front surface) on which liquid is applied of the sheet material P from a back surface side of the transfer cylinder 25 is arranged for a transfer path by the transfer cylinder 25.

As the first dryer 60, an IR heater 60A which heats a surface (back surface) opposite to the surface to which the liquid is applied of the sheet material P is arranged for the transfer path by the transfer cylinder 25.

In this manner, by heating the front and back surfaces of the sheet material P together, the sheet material P may be efficiently dried.

Since preheating is performed in the transfer path by the transfer cylinder 25 having a diameter smaller than that of the drum 51, the sheet material P may be efficiently heated from the front surface and the back surface.

As described above, the transfer cylinder 25 is substantially hollow in a region in a width direction which holds the sheet material P except for the gripper 82, the holding member 84, and the rotating shaft 25*a*. Therefore, the hot air blown from the hot air blower 60B may pass through an inside of the transfer cylinder 25 to be blown to the front surface of the sheet material P gripped by the gripper 82.

By using the transfer cylinder 25 having the diameter smaller than that of the drum 51, a position in which the hot air is blown and a conveying position of the sheet material P may approach to each other across the transfer cylinder 25, so that heat may be efficiently applied.

In this embodiment, hot air temperature of the hot air blower 60B is 60 to 100° C., and the IR heater 60A uses a heat source having a wavelength of 2 to 3 μm.

When the drum 51 is warmed by the hot air from the hot air blower 60B and radiant heat of the IR heater 60A, there is a possibility that a disadvantage to a head forming the liquid discharger 22, for example, condensation might occur.

Therefore, a blowing direction of the hot air from the hot air blower 60B is made a direction in which the drum 51 as a rotary member is not warmed, that is, a direction in which this does not face the surface of the rotary member. As a result, it becomes possible to prevent the head of the liquid discharger 22 facing the rotary member from being heated and causing condensation or the like.

Figure 9:
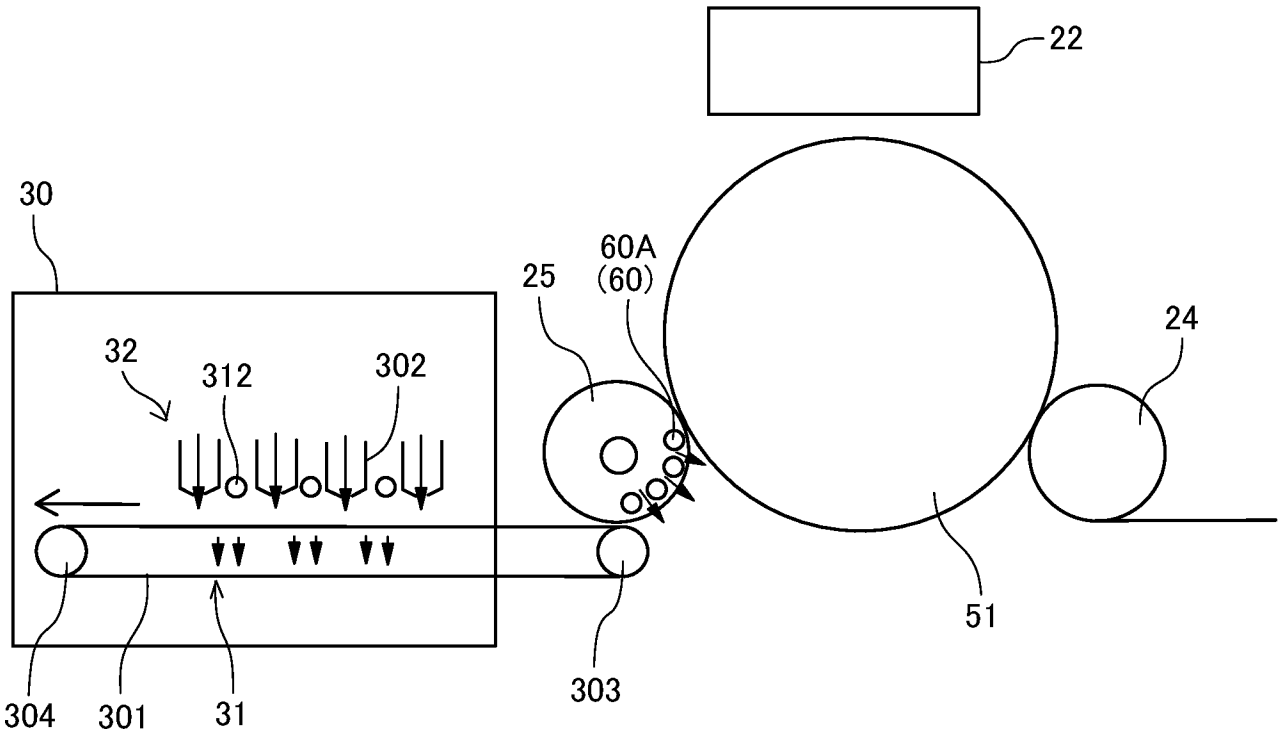
FIG. 9 is a schematic view of a second dryer in a sixth embodiment of the present disclosure.

Next, a second dryer in a sixth embodiment of the present disclosure is described referring to FIG. 9. FIG. 9 is an illustrative view of a substantial part for illustrating the second dryer.

In this embodiment, a drying mechanism 32 being the second dryer includes hot air blowers 302 and an IR heater 312 arranged between the hot air blowers 302.

As a result, an amount of heat applied to a sheet material P by the drying mechanism 32 may be made larger than that in the first embodiment.

The first to sixth embodiments may also be combined with one another.

Figure 10A:
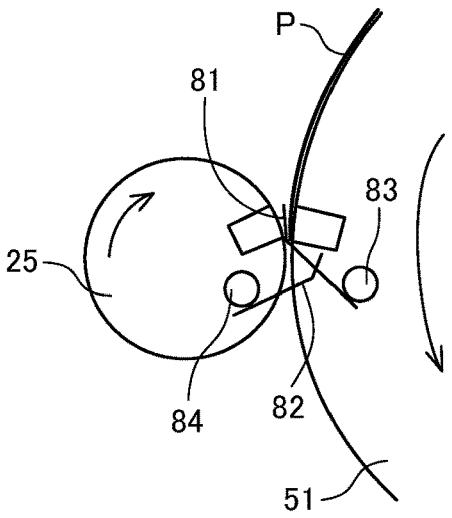
FIGS. 10A to 10C are illustrative views for illustrating an example of a configuration of transfer between a drum and the transfer cylinder in the printing apparatus.
Figure 10B:
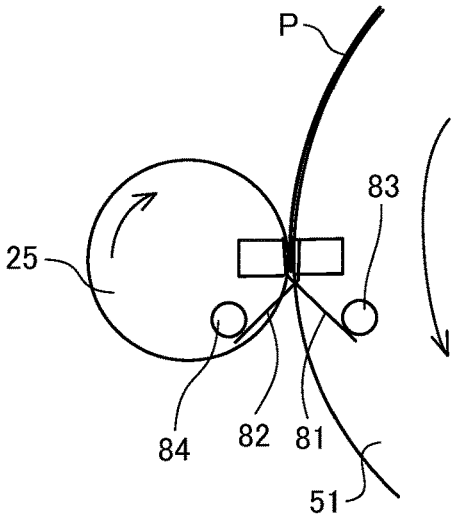
Figure 10C:
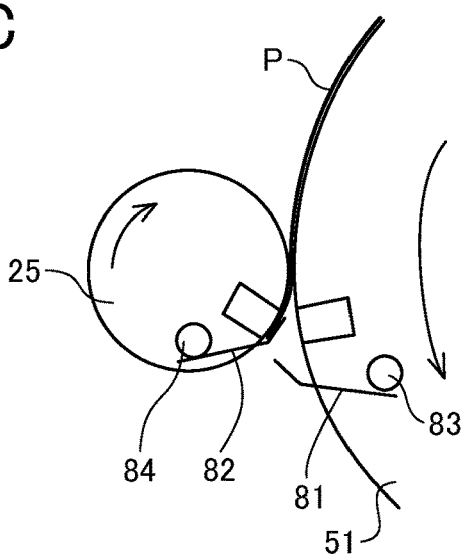

Next, an example of a configuration regarding transfer from the drum to the transfer cylinder in the printing apparatus 1 is described referring to FIGS. 10A to 10C. FIGS. 10A to 10C is an illustrative view for illustrating the same.

The drum 51 includes the gripper (claw) 81 which grips the leading end of the sheet material P, and the transfer cylinder 25 also includes the gripper (claw) 82 which grips the leading end of the sheet material P.

The gripper 81 is held by a holding member 83 arranged inside the drum 51, and the holding member 83 is rotatably arranged. The gripper 82 is held by the holding member 84 arranged inside the transfer cylinder 25, and the holding member 84 is rotatably arranged.

The gripper 81 is configured such that a leading end of the gripper 81 approaches the surface of the drum 51 by a mechanism such as a cum at a timing at which the gripper

81 reaches a predetermined position in a rotational direction in conjunction with the rotation of the drum 51.

Similarly, the gripper 82 is configured such that a leading end of the gripper 82 approaches the surface of the transfer cylinder 25 by a mechanism such as a cum at a timing at which the gripper 82 reaches a predetermined position in a rotational direction in conjunction with the rotation of the transfer cylinder 25.

For example, as illustrated in FIG. 10A, transfer (changing) operation by the grippers 81 and 82 is performed such that the sheet material P is conveyed while the leading end of the sheet material P is pressed by the gripper 81 of the drum 51 from the upstream of a transfer section.

When approaching the transfer section, the gripper 82 of the transfer cylinder 25 also presses the leading end of the sheet material P as illustrated in FIG. 10B.

Thereafter, after passing the transfer section, as illustrated in FIG. 10C, the gripper 81 of the drum 51 is separated and the leading end of the sheet material P is pressed by the gripper 82 of the transfer cylinder 25 to be held.

In this manner, the gripper 82 of the transfer cylinder 25 grips the leading end of the sheet material P which has been gripped by the gripper 81 of the drum 51, so that the sheet material P is transferred from the drum 51 to the transfer cylinder 25.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. An apparatus for discharging liquid, the apparatus comprising:

a rotary member configured to convey a sheet material;

a liquid applier configured to apply liquid to the sheet material conveyed by the rotary member;

a conveyance belt configured to convey the sheet material fed from the rotary member;

a first heater configured to heat the sheet material between the rotary member and the conveyance belt; and a second heater configured to heat the sheet material conveyed by the conveyance belt.

2. The apparatus according to claim 1, comprising a rotary transfer body configured to transfer the sheet material from the rotary member to the conveyance belt, wherein the first heater heats the sheet material on a transfer path of the rotary transfer body.

3. The apparatus according to claim 2, wherein the first heater includes an air blower on a side opposite to a path on which the sheet material is conveyed across the rotary transfer body, wherein the air blower is configured to blow air to the sheet material.

4. The apparatus according to claim 3, wherein a diameter of the rotary transfer body is smaller than a diameter of the rotary member.

5. The apparatus according to claim 3, wherein a blowing direction of the air by the air blower is a direction not facing a surface of the rotary member.

6. The apparatus according to claim 1, wherein the first heater includes an air blower configured to blow air to the sheet material.

7. The apparatus according to claim 1, wherein the first heater includes a radiant heater configured to heat the sheet material.

8. The apparatus according to claim 7, further comprising a guide disposed between the radiant heater and the sheet material and configured to guide the sheet material is arranged.

9. The apparatus according to claim 1, wherein the conveyance belt is a mesh belt.

10. The apparatus according to claim 1, wherein an amount of heat applied by the second heater is larger than an amount of heat applied by the first heater.

11. The apparatus according to claim 1, wherein the liquid is ink including water.

12. An apparatus for discharging liquid, comprising:

a rotary member configured to convey a sheet material;

a liquid applier configured to apply liquid to the sheet material conveyed by the rotary member;

a conveyance belt configured to convey the sheet material fed from the rotary member;

a first drier configured to dry the sheet material between the rotary member and the conveyance belt; and a second drier configured to dry the sheet material conveyed by the conveyance belt.

* * * * *